US007493959B2

(12) United States Patent
Johnson et al.

(10) Patent No.: US 7,493,959 B2
(45) Date of Patent: Feb. 24, 2009

(54) JOINING TUBULAR MEMBERS

(75) Inventors: Craig D. Johnson, Montgomery, TX (US); Matthew R. Hackworth, Pearland, TX (US); Michael D. Langlais, Bartlesville, OK (US); David W. Wang, Manvel, TX (US); Laurent Alteirac, Houston, TX (US); Stephane J. Virally, Sugar Land, TX (US); Jason Bigelow, Trobay (CA); Kerby J. Dufrene, Sugar Land, TX (US); Bruno Khan, Houston, TX (US); Martin Prado, Houston, TX (US); Ashish Sharma, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 180 days.

(21) Appl. No.: 11/461,105

(22) Filed: Jul. 31, 2006

(65) Prior Publication Data

US 2006/0279078 A1 Dec. 14, 2006

Related U.S. Application Data

(62) Division of application No. 10/708,517, filed on Mar. 9, 2004.

(51) Int. Cl.
*E21B 19/16* (2006.01)

(52) U.S. Cl. ..... 166/380; 166/242.6; 166/381

(58) Field of Classification Search ..... 166/242.6, 166/51, 278, 380, 381
See application file for complete search history.

(56) References Cited

U.S. PATENT DOCUMENTS 5,390,966 A * 2/1995 Cox et al. ..... 285/124.2
5,515,915 A * 5/1996 Jones et al. ..... 166/51

* cited by examiner

*Primary Examiner*—Giovanna C Wright
(74) *Attorney, Agent, or Firm*—James L. Kurka; Jeremy P. Welch; Trop, Pruner & Hu, P.C.

(57) ABSTRACT

An apparatus includes a connector to connect a first tubing section and a second tubing section together. The connector that includes a body that includes a first opening to receive the first tubing section, a second opening to receive the second tubing section, and a passageway. The apparatus includes a member that is adapted to be moved from a retracted position to an extended position to form a sealed connection between a tubular member that is connected to the first tubing section and the passageway.

12 Claims, 12 Drawing Sheets

JOINING TUBULAR MEMBERS

CROSS-REFERENCE TO RELATED APPLICATION

This application is a divisional of and claims priority based on U.S. application Ser. No. 10/708,517 filed on Mar. 9, 2004.

BACKGROUND

The invention generally relates to joining tubular members.

When well fluid is produced from a subterranean formation, the fluid typically contains particulates, or "sand." The production of sand from the well must be controlled in order to extend the life of the well. One technique to accomplish this involves routing the well fluid through a downhole filter formed from gravel that surrounds a sandscreen. More specifically, the sandscreen typically is a cylindrical mesh that is inserted into and is generally concentric with the borehole of the well where well fluid is produced. Gravel is packed in the annular area between the formation and the sandscreen, called the "annulus." The well fluid being produced passes through the gravel, enters the sandscreen and is communicated uphole via tubing that is connected to the sandscreen.

The gravel that surrounds the sandscreen typically is introduced into the well via a gravel packing operation. In a conventional gravel packing operation, the gravel is communicated downhole via a slurry, which is a mixture of fluid and gravel. A gravel packing system in the well directs the slurry around the sandscreen so that when the fluid in the slurry disperses, gravel remains around the sandscreen.

In a conventional gravel packing operation, fluid may prematurely leave the slurry. When this occurs, a bridge forms in the slurry flow path, and this bridge forms a barrier that prevents slurry that is upstream of the bridge from being communicated downhole. Thus, the bridge disrupts and possibly prevents the application of gravel around some parts of the sandscreen.

For purposes of circumventing any possible bridges, a system for packing a well may include alternate path transport tubes, tubes that provide, as their names imply, alternative paths for communicating the slurry down into the well. In effect, the transport tubes serve as shunts in that should a bridge form, one of the transport tubes serves to bypass the bridge to permit slurry to be introduced into the well beyond the bridge.

The use of transport tubes may present various challenges. For example, a typical system for gravel packing a well may include a production tubing and one or more transport tubes that are located on the outside of the production tubing. The production tubing and transport tubes are assembled together on a section-by-section basis as these components are lowered downhole. Thus, a potential challenge in the use of transport tubes is that for each section of the system to be lowered downhole, both production tubing and transport tube sections must be joined together. This task is complicated because the transport tube sections (that are attached to the production tubing section) must be aligned with and sealed to adjacent transport tube sections.

Similar challenges may exist when assembling other types of downhole tubular members together, such as control line and production tubing sections.

Thus, there is a continuing need for an arrangement that addresses one or more of the problems set forth above as well as addresses one or more problems that are not set forth above.

SUMMARY

In an embodiment of the invention, an apparatus includes a first connector and a member. The first connector connects a first tubing section and a second tubing section together. The member is adapted to be moved from a retracted to an extended position to form a sealed connection between the first tubular that is connected to the first tubing section and a second tubular member that is connected to the second tubing section.

In another embodiment of the invention, an apparatus includes a first connector and a member. The first connector forms a connection between a first tubing section and the second tubing section and leaves a gap between a first end of a first tubular member that is connected to the first tubing section and a second end of a second tubular member that is connected to the second tubing section. The member is inserted into the gap to seal the first tubular member and the second tubular member together.

In another embodiment of the invention, an apparatus includes a pin end that includes a first passageway in communication with a first tubular member and a second passageway in communication with a first production tubing section. The apparatus also includes a box end that is adapted to receive the pin end. The box end includes a third passageway that is in communication with a second tubular member and a fourth passageway that is in communication with a second tubing section. The apparatus includes a locking mechanism to secure the pin end and the box end together.

Advantages and other features of the invention will become apparent from the following description, drawing and claims.

DETAILED DESCRIPTION

Figure 1:
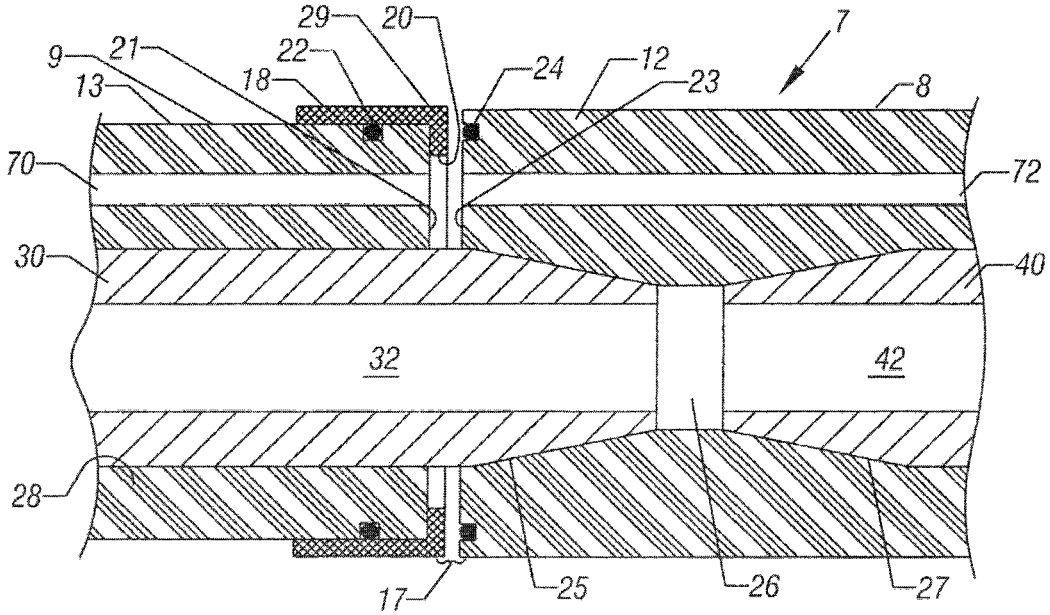
FIGS. 1 and 2 are schematic diagrams depicting a box coupler in which a sliding sleeve is used to seal transport tube sections according to an embodiment of the invention.

Referring to FIG. 1, an embodiment 7 of a box coupler in accordance with the invention facilitates the connection of production tubing and transport tube sections together. More particularly, in some embodiments of the invention, the box coupler 7 may be generally concentric with respect to two production tubing sections 30 and 40 that are joined by the coupler 7. The box coupler 7 receives adjoining ends of the production tubing sections 30 and 40 and permits these sections 30 and 40 to be threaded into the box coupler 7 until desired torque forces are met. The box coupler 7 includes a sleeve 18 that, as described below, slides into position after the production tubing section 30 and 40 are connected to the box coupler 7 for purposes of forming sealed connections between adjacent transport tube sections. One of the transport tube sections is connected to the production tubing section 30, and the other transport tube section is connected to the production tubing section 40.

More particularly, in some embodiments of the invention, the box coupler 7 includes a box end 8 that is constructed to receive an end of the production tubing section 30 and an end of the production tubing section 40. As described below, the box end 8 sealably and mechanically connects the production tubing sections 30 and 40 together. The pin end 9 contains the sleeve 18 and is attached to the production tubing section 30. For purposes of establishing communication between the connected transport tube sections, the box end 8 includes a passageway 72, and the pin end 9 includes a passageway 70. After the production tubing section 30 is threaded into the box end 8 and the appropriate torque force is applied to the production tubing section 30, by design, a gap 17 exists between the passageway 72 of the box end 7 and the passageway of the pin end 9. This gap 17 establishes a tolerance range for securing the production tubing sections 30 and 40 together to ensure that the proper level of torque may be used when assembling the production tubing section 30 to the body 8.

Thus, the box coupler 7 ensures that 1. the production tubing sections 30 and 40 are connected and sealed to the coupler 7 with the proper torque force; and 2. a seal is formed between the transport tube section passageways 70 and 72.

Although the arrangement described above connects production tubing sections, it is noted that the box couplers that are described herein may alternatively couple injection tubing sections together when used in an injection well. Thus, in some embodiments of the invention, the production tubing sections may be replaced by injection tubing sections. For purposes of simplifying the discussion herein, the box couplers are described as connecting production tubing sections, although it is understood that injection tubing sections may be substituted for the production tubing sections in other embodiments of the invention.

In some embodiments of the invention, the box end 8 includes a body 12 that, prior to the assembly of the box coupler 7, is threadably connected and sealed to the production tubing section 40 and a transport tube section (not shown). More specifically, in some embodiments of the invention, the body 12 has a tapered threaded opening 27 that is constructed to receive and form a seal with a mating tapered end of the production tubing section 40. On its opposite end, the body 12 includes a tapered threaded opening 25 that is constructed to receive and form a seal with a corresponding tapered threaded end of the production tubing section 30. The openings 25 and 27 are concentric with each other and are joined together by a longitudinal passageway 26. Therefore, when the production tubing sections 30 and 40 are threaded into the openings 25 and 27, the box coupler 7 forms a sealed connection that unites the two production tubing sections 30 and 40 to effectively form a continuous section of pipe from the two sections 30 and 40.

The transport tube passageway 72 is formed in the body 12 and is eccentric to and generally parallel with the central axis of the passageway 26. When the box coupler 7 is assembled, the passageway 72 is generally aligned with the passageway 70 that extends through a body 13 of the pin end 9 of the box coupler 7. Similar to the body 12, the body 13 is connected to another transport tube section (not depicted in FIG. 1) through a sealed connection (also not depicted in FIG. 1). The production tubing section 30 extends through a passageway 28 of the body 13 so that the tapered end of the production tubing section 30 extends past the body 13 for purposes of connecting this end to the body 12 of the box end 8.

In some embodiments of the invention, a gap is formed between opposed annular faces 23 and 21 of the bodies 12 and 13, respectively. The sleeve 18, in some embodiments of the invention, generally circumscribes the exterior surface of the body 13 and has an end 29 that radially extends into the gap between the two annular faces 21 and 23. The end 29, in turn, includes an annular opening 20 that permits communication between the fluid passageways 70 and 72. In the sleeve's retracted position, the end 29 is closest to the annular face 21, to establish the tolerance gap 17 between the end 29 and the annular face 23.

Figure 2:
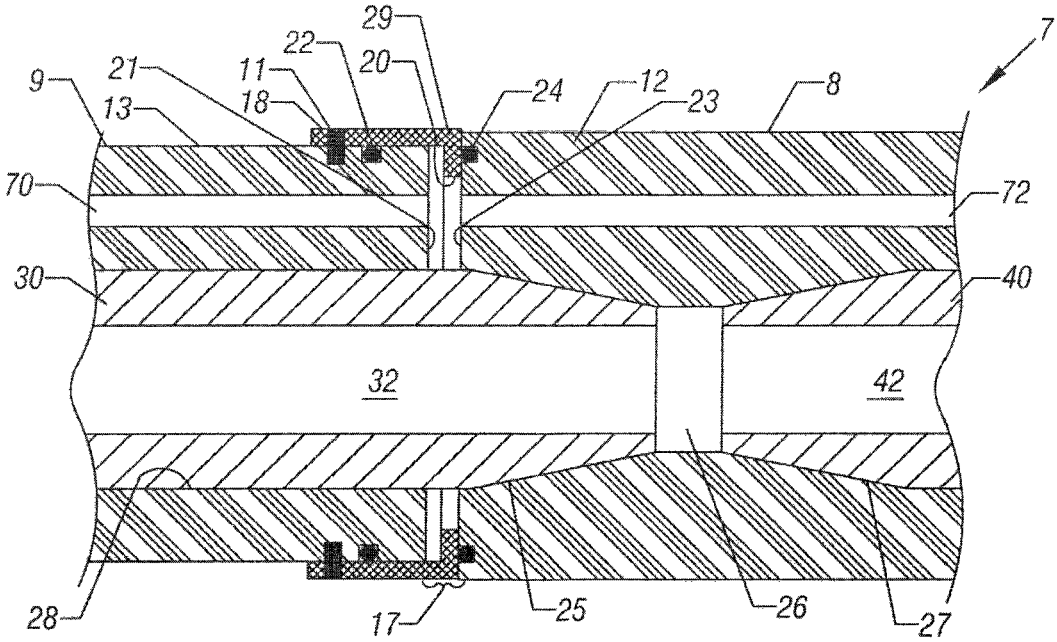

After the production tubing sections 30 and 40 have been connected to the body 12, the sleeve 18 may be slid from its retracted position toward the annular face 23 to bridge the gap 17 and sealably connect the passageways 70 and 72 together. Referring to FIG. 2, more specifically, when the sleeve 18 slides to and abuts the annular face 23, the extension 29 forms a seal with the annular face 23. In this regard, in some embodiments of the invention, the annular face 23 includes an annular groove that receives an O-ring 24 that forms a face seal between the annular face 23 and the extension 29 of the sleeve 18. Thus, the O-ring 24 forms a seal between the sleeve 18 and the box end 8 when the sleeve 18 is in its fully extended position.

For purposes of forming a seal between the pin end 9 and the sleeve 18, in some embodiments of the invention, the pin end 9 includes an O-ring 22 that resides in an annular groove that is formed in the exterior surface of the body 13 and contracts the underside of the sleeve 18.

As depicted in FIG. 2, in some embodiments of the invention, a retaining device 11 may be used to keep the sleeve 18 in its fully extended position. The retaining device 11 may be, by way of example, a set screw, a jam nut, a retaining ring, and/or a combination of one or more of the elements. Furthermore, multiple set screws, jam nuts or retaining rings may be used to hold the sleeve 18 in its extended position, according to the particular embodiment of the invention.

Thus, referring both to FIGS. 1 and 2, for purposes of connecting transport tube sections and the production tubing sections 30 and 40 together, in some embodiments of the invention, the end of the production tubing section 30 is first inserted into the passageway 28 of the pin end 9 so that the pin end 9 can be attached (welded or threaded to, for example) to the section 30. At this point the associated transport tube section is attached to the pin end 9 to establish communication between the transport tube section and the passageway 70.

The end of the production tubing section 40 is threaded into the threaded opening 27 of the box end 8; and the associated transport tube section is connected to the box end 8 so that the transport tube section is in communication with the passageway 72. Subsequently, the end of the production tubing section 30 is threaded into the tapered opening 25 of the box end 8 and turned to the appropriate level of torque. Next, the sleeve 18 is moved into its fully extended position so that the extension 29 abuts the annular face 23 of the body 12 to form a sealed connection between the box end 8 and the pin end 9. The retaining device 11 is then used to fix the sleeve 18 in place.

Figure 3:
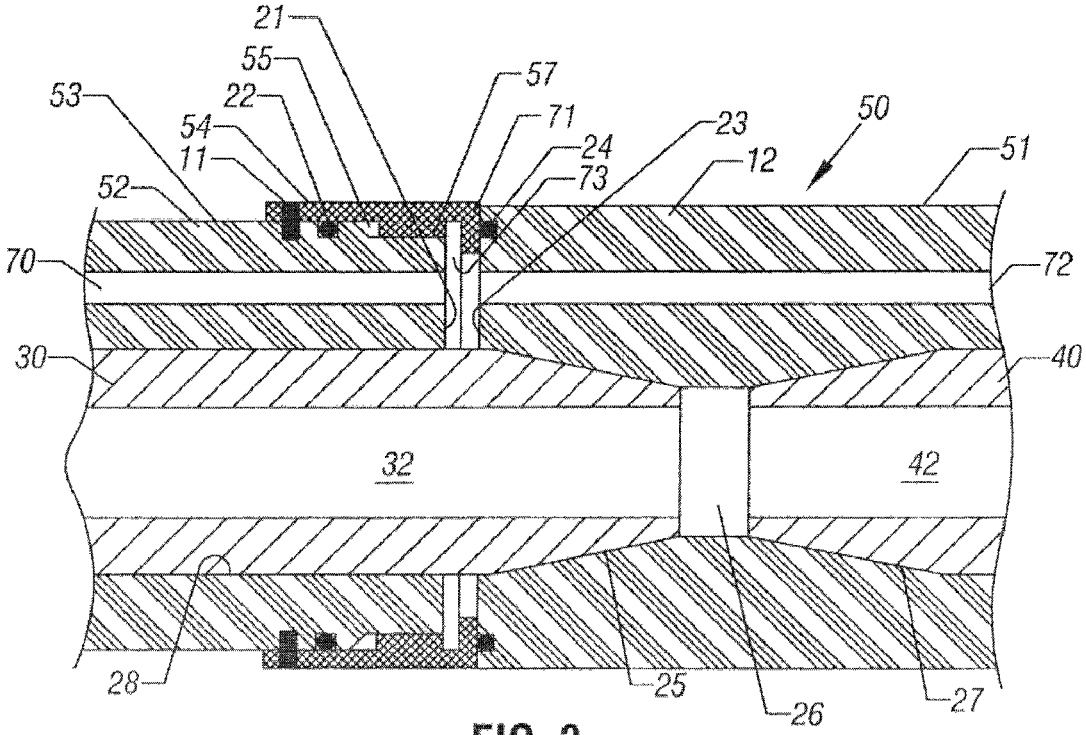
FIGS. 3 and 4 are schematic diagrams of box couplers that include threaded sleeves to seal transport tube sections according to different embodiments of the invention.

Referring to FIG. 3, in some embodiments of the invention, another box coupler 50 may be used in place of the box coupler 7 (FIGS. 1 and 2). The box coupler 50 has a similar design to the box coupler 7, except for the following differences. In particular, a box end 51 of the box coupler 50 has a similar design to the box end 8 of the box coupler 7. However, a pin end 52 of the box coupler 50 includes a different body 53 (that replaces the body 13 of the box coupler 7) and sleeve 54 (that replaces the sleeve 18 of the box coupler 7).

Similar to the box coupler 7, the pin end body 53 includes a transport tube passageway 70 that communicates fluid for an associated transport tube section (not shown); and the body 53 has a passageway 28 for receive an end of the production tubing section 30. Unlike the body 13 of the box coupler 7, the body 53 has a recessed region 55 on its exterior surface to receive a threaded extension component of the sleeve 54. More specifically, in some embodiments of the invention, the sleeve 54 generally circumscribes the exterior surface of body 53. Similar to the sleeve 18 of the box coupler 7, the sleeve 54 includes an annular extension 71 that radially extends into a gap created between opposing annular faces 21 and 23 of the bodies 12 and 53. The extension 71 includes an opening 73 that permits fluid communication between the passageways 70 and 72 when the box coupler 50 is assembled together.

The recessed region 55 includes threads 57 (on the exterior surface of the body 53) that mate with corresponding interior threads of the sleeve 54. Thus, to form the sealed connection between the passageways 70 and 72, the sleeve 54 is rotated about the longitudinal axis of the box coupler 50 so that the sleeve 54 moves from a retracted position to an extended position in which the extension 71 abuts the annular face 23 of the body 12. Similar to the box coupler 7, O-rings 22 and 24 form seals between the sleeve 54 and the pin 51 and box 52 ends. Additionally, the box coupler 50 may include a retaining device 11 to secure the sleeve 54 in its fully extended position.

Figure 4:
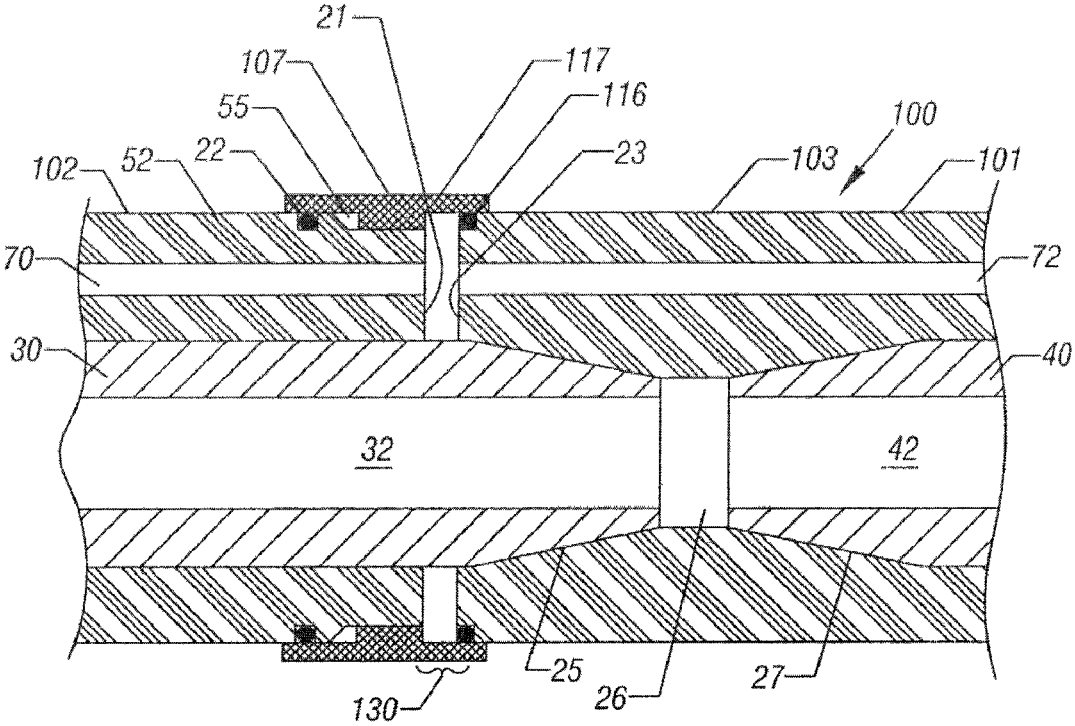

Other variations are possible. For example, in some embodiments of the invention, instead of the sleeve forming a face seal with the annular face of the box body, the sleeve may instead, form a seal with the outer surface of the box body. Such an arrangement is depicted in FIG. 4 for an embodiment of a box coupler 100. The box coupler 100 has a similar design to the box coupler 50 (FIG. 3), with the differences being pointed below. The box coupler 100 includes a box end 101 that includes a body 103 that is similar to the body 12 of the box couplers 7 and 50, except that the body 103 includes a groove in its exterior surface to receive an O-ring 116. This O-ring 116, in turn, forms a seal between the box end 101 and a sleeve 107 (that replaces the sleeve 54 of the box coupler 50) of the box coupler 100. A pin end 102 of the box coupler 100 includes the body 52 and a sleeve 107.

The sleeve 107 does not contain an extension into the gap between the bodies 52 and 103. Rather, the sleeve 101 includes a longitudinal extension 117 that bridges the gap between the adjacent annular faces 21 and 23 of the bodies 52 and 103, respectively. In its extended position, the extension 117 slides over at least a portion of the exterior of the body 103 to contact the O-ring 116 and form a seal with the box end 101. The sleeve 107 otherwise has a similar design to the sleeve 54 of the box coupler 50.

Figure 5:
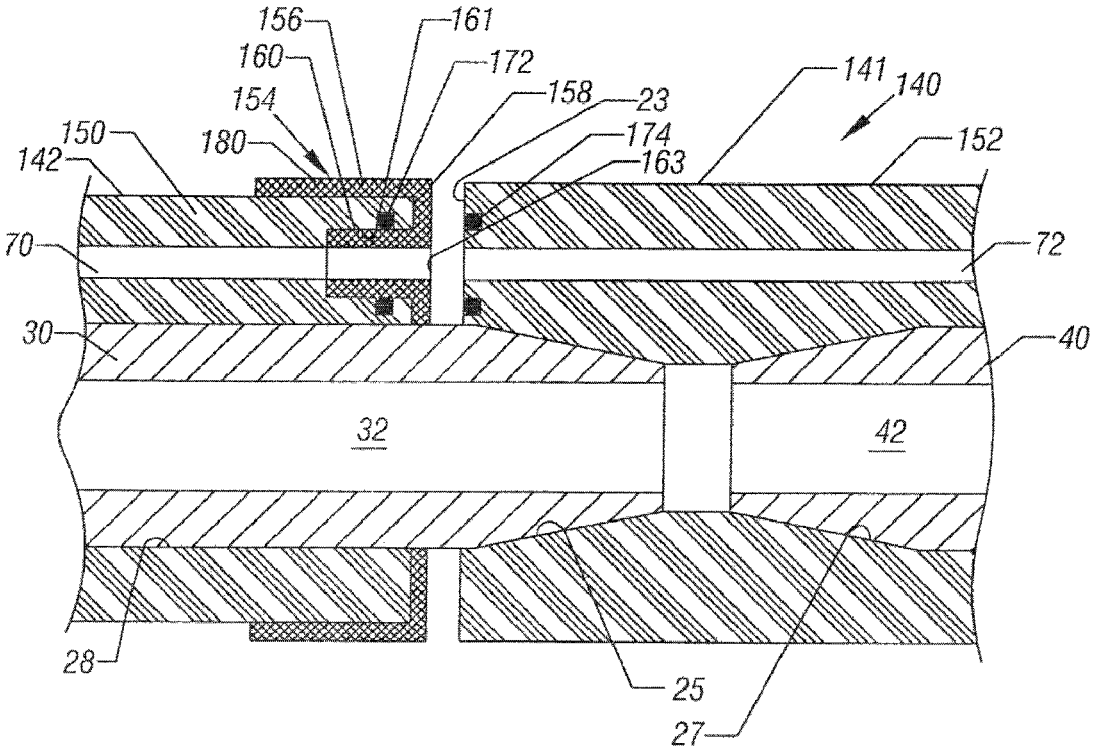
FIGS. 5 and 6 are schematic views of a box coupler that provides an inner diameter seal on a transport tube section being connected by the box coupler according to an embodiment of the invention.

Referring to FIG. 5, in another embodiment of the invention, a box coupler 140 includes a sleeve 154 that extends into the transport tube passageway 70 to form a seal with the wall of the passageway 70. More particularly, the box coupler 140 includes a box end 141 that includes a body 152 that is similar in design to the body 51 of the box coupler 50 (FIG. 3), with the differences being described below. Unlike the body 51, the body 152 includes an annular groove that holds an O-ring 174 (in place of the O-ring 24) to form a face seal between the annular face 23 of the body 152 and the sleeve 154. The O-ring 174 circumscribes the opening of the transport passageway 72 at the annular face 23.

A pin end 142 of the box coupler 140 includes the sleeve 154 that circumscribes a body 150 of the pin end 142. The body 150 is similar to the bodies of the previously-described pin ends, except that the body 150 is constructed to receive the sleeve 154 inside the passageway 70 and form seals between the wall of the passageway 70 and the sleeve 154. More specifically, in some embodiments of the invention, the sleeve 154 includes an outer section 156 that circumscribes the exterior of the body 150 and an interior section 160 that protrudes inside the passageway 70. The interior section 160 of the sleeve 154 resides inside an annular recessed region 161 (of the body 150) that circumscribes the passageway 70. The region 161 has a radial dimension that accommodates the thickness of the interior section 160 of the sleeve 154 so that the sleeve 154 does not obstruct the passageway 70. As depicted in FIG. 5, the body 150 includes an annular groove that is formed in the body 150, circumscribes the sleeve 154 and holds an O-ring 172 that forms a seal between the sleeve 154 and the body 150.

An end, or radial extension 158, of the sleeve 152 links the outer 156 and interior 160 sections of the sleeve 154 together. The interior section 160 of the sleeve 154 includes an opening 163 for purposes of allowing communication between the passageways 70 and 72.

Figure 6:
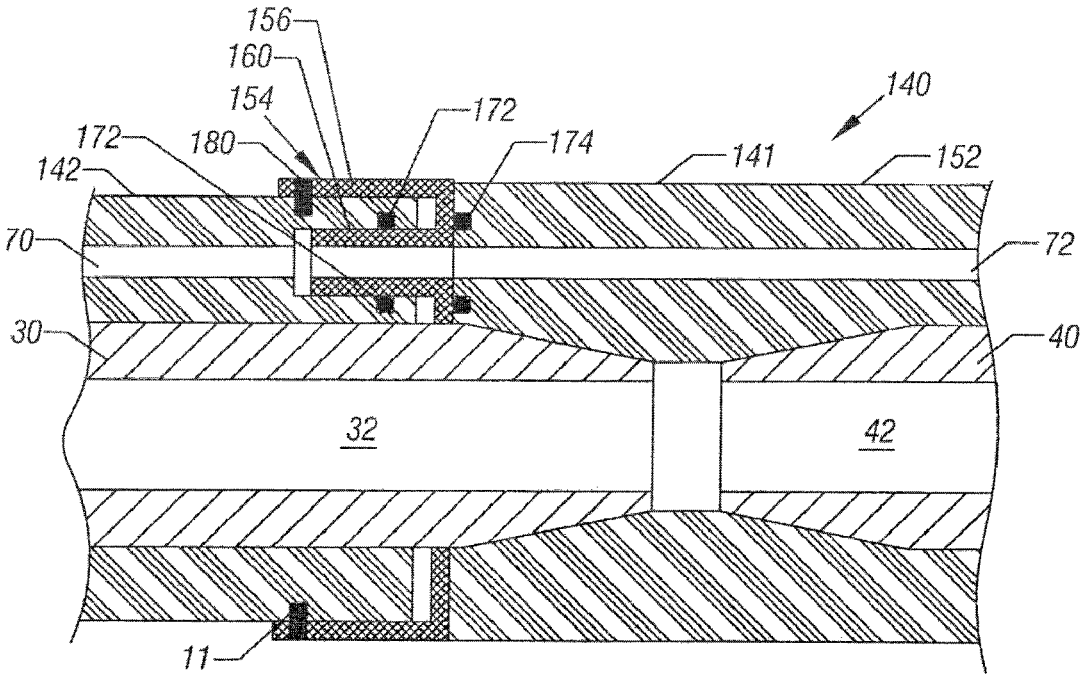

FIG. 5 depicts a retracted position of the sleeve 154. In this state, a gap exists between the radial extension 158 of the sleeve 154 and the annular face 23 of the body 152. This gap permits proper connection of the production tubing sections 30 and 40. When the sleeve 154 is fully extended, as depicted in FIG. 6, the radial extension 158 contacts the O-ring 174 to form a face seal with the body 152. Thus, because a seal exists between the sleeve 154 and the body 152, in its extended position, the sleeve 154 forms a seal between the passageways 70 and 72.

Figure 7:
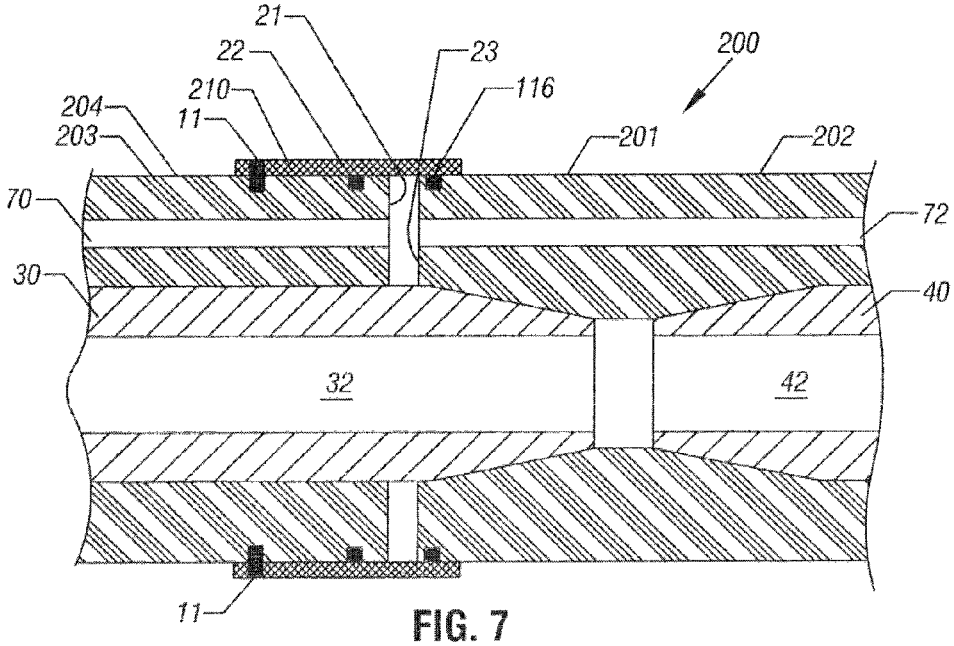
FIG. 7 is a schematic diagram of a box coupler in accordance with an embodiment of the invention that provides outer diameter seals and no face seal on transport tube sections connected by the box coupler according to an embodiment of the invention.

FIG. 7 depicts a box coupler 200 in accordance with another embodiment of the invention. The box coupler 200 does not form face seals for purposes of sealably connecting the passageways 70 and 72 together. Instead, the box coupler 200 forms outer seals on the bodies of the box coupler 200 for purposes of sealing the passageways 70 and 72 together.

More specifically, in some embodiments of the invention, the box coupler 200 includes a box end 201 that includes a body 202 that has a similar design to the body 103 of the box coupler 100 (FIG. 4). Thus, the body 202 includes an annular groove that is located in an exterior surface of the body 202 and circumscribes the longitudinal axis of the body 202. This annular groove holds an O-ring 116 that forms a seal with a sleeve 210 of the box coupler 200 when the sleeve 210 is moved into its extended position (as depicted in FIG. 7).

The box coupler 200 also includes a pin end 203 that includes a body 204 that has a similar design to the body 13 of the box coupler 7 (FIG. 1). Thus, the body 202 includes an annular groove that is located in an exterior surface of the body 204 and circumscribes the longitudinal axis of the body 204. This annular groove holds an O-ring 22 that forms a seal with the sleeve 210.

The sleeve 210 is generally cylindrical and circumscribes the body 204 in both its extended and retracted positions to form a seal with body 204 (via the O-ring 22). In its extended position (depicted in FIG. 7), the sleeve 210 circumscribes and forms a seal with the body 202. Thus, in its extended position, the sleeve 210 seals the passageways 70 and 72 together.

Figure 8:
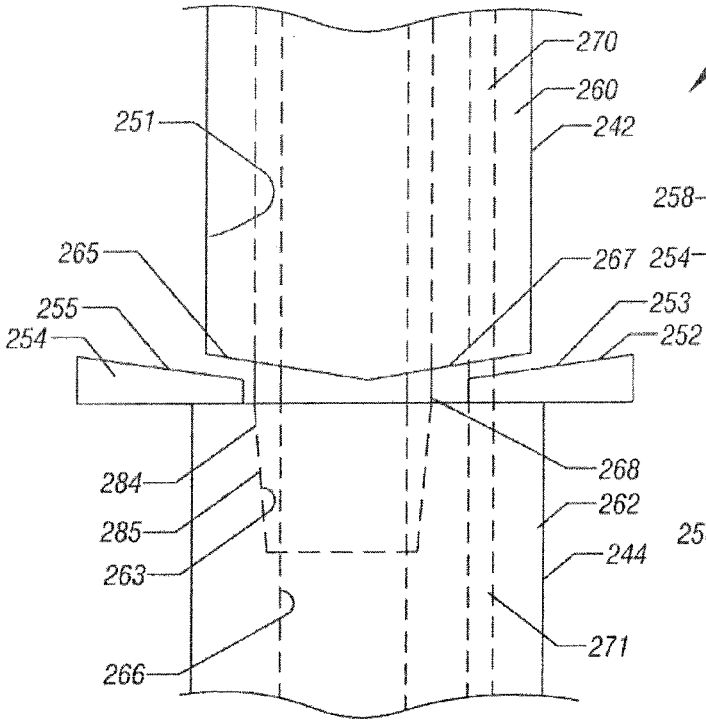
FIG. 8 is a schematic diagram of a box coupler that uses wedges to seal transport tube passageways according to an embodiment of the invention.

In other embodiments of the invention, a box coupler may use mechanisms other than a sleeve to secure and seal production tubing and/or transport tube sections together. For example, FIG. 8 depicts a box coupler 240 that includes a box end 244 and a pin end 242. The pin end 242 includes a pin body 260 that includes a transport tube passageway 270 to communicate fluid to a transport tube passageway 271 of the box end body 262. The pin body 260 also includes a longitudinal passageway 251 that receives a production tubing section 284. The production tubing section 284 is attached (threaded or welded to, as examples) to the pin body 260. A threaded end 285 (a tapered end, for example) of the production tubing section 284 protrudes past the end of the pin body 260 so that the end 285 may be threaded into a corresponding tapered opening 263 of a body 262 of the box end 244 of the box coupler 250. Not shown in FIG. 8 is the connection of a lower production tubing section to the box end body 262 of the box coupler 250. A fluid passageway 266 of the body 262 communicates fluid between this lower production tubing section and the production tubing section 284.

When the production tubing section 284 is threaded into the box end 244 and an appropriate torque force is applied to the section 284, a gap exists between the pin body 242 and box body 244. Instead of closing this gap with a sleeve, the box coupler 240 fills in the gap with wedges. More particularly, in accordance with some embodiments of the invention, the end of the pin body 260 nearest the box end 244 has faces 265 and 267 that are inclined relative to a flat surface 268 of the adjacent end of the box body 262. More specifically, in accordance with some embodiments of the invention, the surface 268 has a surface normal that is parallel to the longitudinal axis of the box coupler 240; and the faces 265 and 267 each have a surface normal that is not parallel to the longitudinal axis but instead has a radial component. As depicted in the side view shown in FIG. 8, the face 267 has a positive slope with respect to the surface 268; and the face 265 has a negative slope with respect to the surface 268.

The box coupler 240 is constructed so that when the production tubing section 284 connects to the body 262 (via a timed thread, for example), a gap is formed between the faces 265 and 267 and the face 268. Due to this gap, two half-disk wedges 252 and 254 may be inserted into the gap between the opposing faces 265, 267 and 268 of the bodies 260 and 262. More specifically, the wedge 252 may be inserted between the inclined face 267 and the corresponding part of the face 268; and the wedge 254 may be inserted between the inclined face 265 and the corresponding portion of the face 268.

Figure 9:
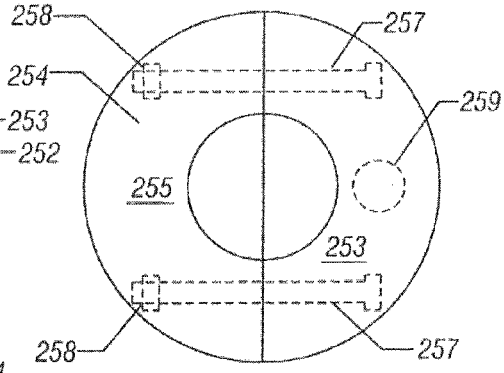
FIG. 9 is a top view of the wedges of FIG. 8 when assembled according to an embodiment of the invention.

When fully inserted to fill in the gap, the two wedges form a disk, a top view of which is depicted in FIG. 9. As shown, the wedge 254 includes an inclined face 255 that follows the surface 265; and the wedge 252 includes an inclined face 253 that follows the inclined surface 267. The wedge 252 may also include a port 259 that permits communication between the transport tube passageways 270 and 272. In some embodiments of the invention, bolts 257 may be used to connect the wedges 252 and 254 together after their insertion into the gaps between the bodies 260 and 262. The bolts 257 thread into corresponding nuts 258. Other connectors may alternatively be used, in other embodiments of the invention.

Figure 10:
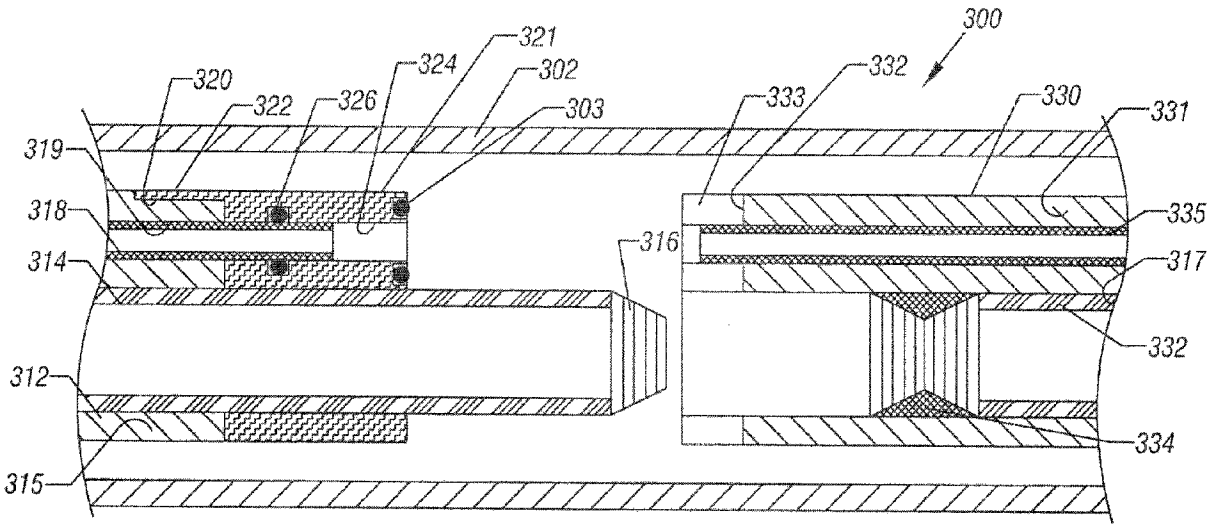
FIGS. 10-12 depict a box coupler that use a sliding sleeve to connect transport tube sections and a stabbing connection to connect production tube sections according to an embodiment of the invention.

FIG. 10 depicts a box coupler 300 in accordance with another embodiment of the invention. The box coupler 300 may be located inside of a shroud 302. The box coupler 300 includes a sleeve 321 that slides from a retracted position to an extended position to form a seal between two transport tube sections. However, unlike the box couplers described above, the sleeve 321 slides over the ends of the two transport tube sections that are being connected together.

More specifically, the box coupler 300 connects a transport tube section 318 to a transport tube section 335 and connects a production tubing section 314 to a production tubing section 332. The box coupler 300 includes a pin end that is connected to the transport tube section 318 and the production tubing section 314. The pin end includes a body 312 that includes a passageway 319 that receives an end of the transport tube section 318. Furthermore, the body 312 includes a passageway 315 to receive an end of the production tubing section 314 so that the production tubing section 314 extends to expose its end 316 for connection to the box end. In some embodiments of the invention, both the transport tube section 318 and the production tubing section 314 are attached (via a threaded or welded connection, as examples) to the pin end body 312.

In some embodiments of the invention, the box end of the box coupler 300 includes a body 330 that includes a passageway 331 to receive an end of the transport tube section 335. The end of the transport tube section 335 protrudes past an end of the passageway 331 into an opening that receives a sleeve of the box coupler 300, as further described below. Besides the passageway 331, the body 330 also includes a passageway 317 for receiving the end of a production tubing section 332. Inside the passageway 317, the end of the production tubing section 332 connects to a stab coupler 334. The stab coupler 334, in turn, provides an opening for receipt of the end 316 of the production tubing 314 when the box coupler 300 is assembled together.

Figure 11:
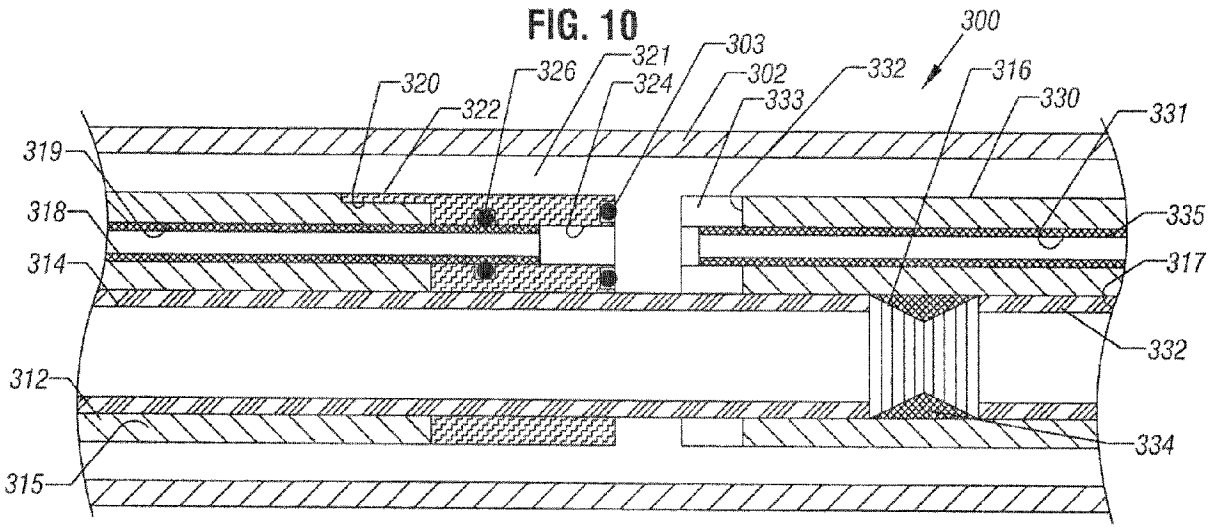

Referring also to FIG. 11, thus, when the production tubing sections 314 and 332 are joined together via the coupler 334, a section of production tubing is formed from the two smaller production tubing sections 314 and 332. The box coupler 300 also includes a sliding mechanism, described below, for mating the transport tube sections 318 and 335 together.

In some embodiments of the invention, the end of the transport tube section 318 extends past the opening 319 in the body 312 into a passageway 324 of a sleeve 322 that generally circumscribes the production tubing section 314. The sleeve passageway 324 is generally eccentric with respect to the longitudinal axis of the passageway 315. The sleeve 322 slides with respect to the transport tube section 318 for purposes of forming a connection between the transport tube sections 318 and 335.

Figure 12:
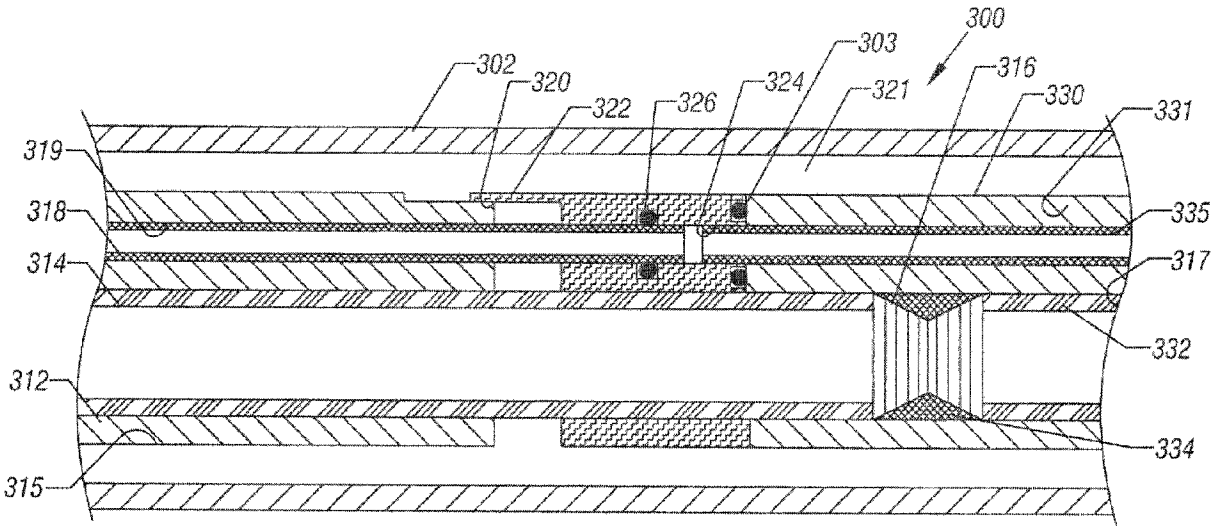

More specifically, in some embodiments of the invention, the box coupler 300 includes an O-ring seal 326 that resides in an annular groove that circumscribes the passageway 324 and provides a seal between the wall of the passageway 324 and the exterior surface of the transport tube section 318. The sleeve 322 is free to slide with respect to the transport tube section 318 when the box coupler 300 is unassembled. Thus, as depicted in FIG. 11, when the production tubing sections 314 and 332 are joined by the box coupler 300, the sleeve 322 may slide for purposes of forming a sealed connection between the transport tube sections 318 and 335. More specifically, in some embodiments of the invention, the end of the sleeve 322 includes an O-ring 303 that resides in an annular groove that is formed at the end of the sleeve 322 and circumscribes the passageway 321. The O-ring 303 forms a face seal between an annular face 327 of the sleeve 322 and an annular face 332 of the opening 333 of the body 330 of the box end when the sleeve 322 is in its extended position, depicted in FIG. 12.

Figure 13:
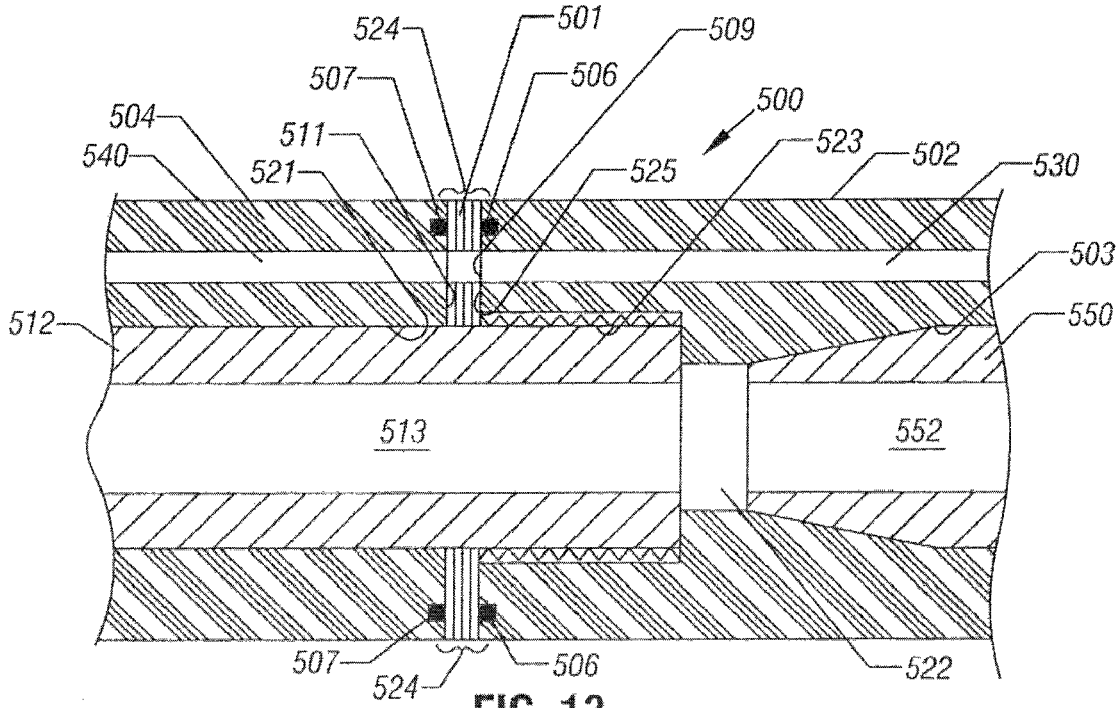
FIG. 13 is a schematic diagram of a box coupler in which shims are used to seal transport tube sections according to an embodiment of the invention.

FIG. 13 depicts a box coupler 500 in accordance with another embodiment of the invention. The box coupler 500 uses shims 501 to fill in a gap 524 between pin and box ends of the box coupler 500 for purposes of sealing longitudinal passageways 530 and 540 that communicate fluid for corresponding transport tube sections.

More specifically, in some embodiments of the invention, the box coupler 500 includes a box end that is generally formed from a body 502. The body 502 includes an opening 503 (a tapered opening, for example) to receive the tapered threaded end of a production tubing section 550. Furthermore, in some embodiments of the invention, the body 502 includes an opening 523 (a non-tapered opening, for example) to receive the end of a production tubing section 512. The openings 503 and 523 communicate through a passageway 522 of the body 502. Thus, in some embodiments of the invention, when the production tubing section 512 is threaded into the opening 523 and the production tubing section 550 is threaded into the opening 503, communication between a passageway 513 of the production tubing section 512 and a passageway 552 of the production tubing 550 occurs through the passageway 522.

In some embodiments of the invention, the pin end of the box coupler 500 includes a body 504 that includes a passageway 521 through which the production tubing section 512 extends. The body 504 may be attached (via threads or welding, for example) to the production tubing 512. In some embodiments of the invention, the body 504 and production tubing 512 may be attached via timed threads for purposes of aligning these two sections together. Other arrangements are possible in other embodiments of the invention.

When the production tubing sections 512 and 550 are threaded into the box end of the box coupler 500, a gap 524 exists between an annular face 511 of the body 504 and an opposing annular face 525 of the body 502. In accordance with some embodiments of the invention, this gap 524 is filled via the shims 501 to the appropriate thickness to form a seal between the transport tube passageways 530 and 540. More specifically, in some embodiments of the invention, an O-ring 507 resides in an annular groove that is located in the annular face 511 and circumscribes the longitudinal axis of the box coupler 500. The O-ring 507 forms a seal between the annular face 511 and the shims 501. Likewise, on the other side of the shims 501, an O-ring 506 resides in an annular groove that is located in the annular face 525 and circumscribes the longitudinal axis of the box coupler 500. The O-ring 506 forms a seal between the annular face 525 and the shims 501.

The number and/or thickness of the shims 501 are a function of the magnitude of the gap 524. As depicted in FIG. 13, each shim has an opening 509 to permit communication between the passageways 530 and 540.

Figure 14:
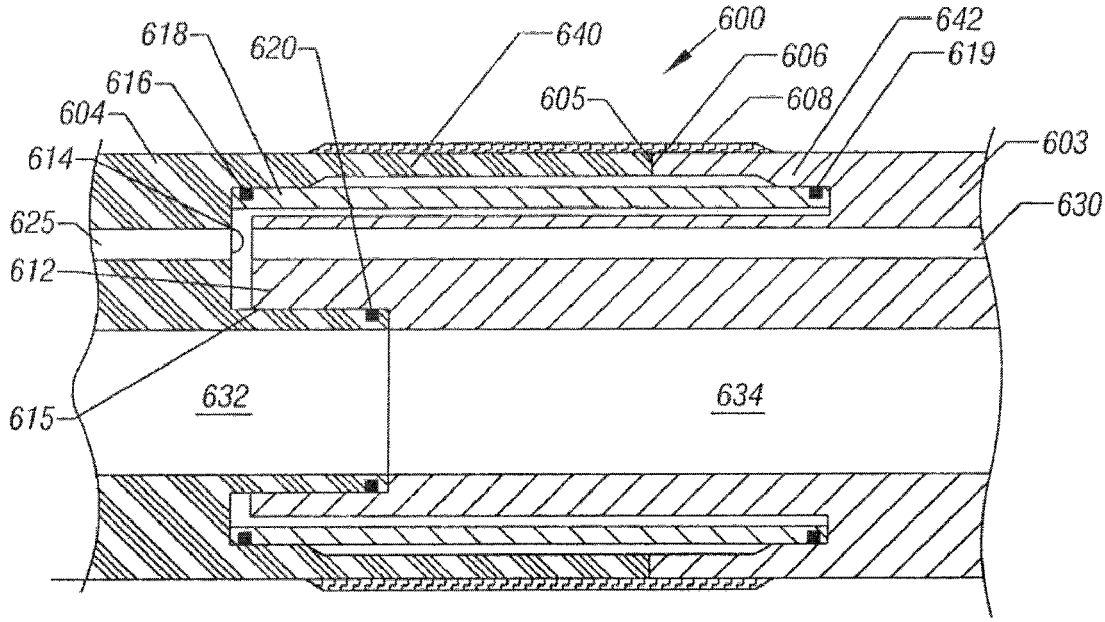
FIG. 14 is a schematic diagram of a box coupler in which pin and box ends are connected with a snap latch according to an embodiment of the invention.

Referring to FIG. 14, in some embodiments of the invention, a box coupler 600 may form a snap connection between the pin and box ends of the coupler 600. More specifically, in some embodiments of the invention, the coupler 600 may include a pin end that is generally formed from a body 603 and a box end that is generally formed from a body 604.

The pin end body 603 includes a passageway 630 for purposes of communicating fluid from a transport tube section (not shown in FIG. 14) that is connected to the body 603; and the box end body 604 includes a passageway 625 for communicating fluid from another transport tube section (not shown in FIG. 14) that is connected to the body 604. Additionally, the pin end body 603 includes a passageway 634 for communicating fluid from a corresponding production tubing section (not shown) that is connected to the body 603; and the box end body 604 includes a passageway 632 for communicating fluid from another production tubing section (not shown in FIG. 14) that is connected to the body 604.

The box coupler 600 sealably connects the transport tube passageways 625 and 630 together; and sealably connects the production tubing passageways 632 and 634 together in the following manner. The pin end body 603 includes a longitudinal extension 612 that generally extends into an annular groove 614 of the box end body 604 when the box coupler 600 is assembled together. The annular groove 614 circumscribes the longitudinal axis of the passageway 632. The transport tube passageway 630 is routed through the extension 612 so that when the box coupler 600 is assembled, the transport tube passageways 630 and 625 align, as depicted in FIG. 14.

The box coupler 600 includes seals to seal off its passageways. More specifically, in some embodiments of the invention, the O-ring 620 may be located in an annular groove that is located inside a wall of the annular groove 614 and generally circumscribes the longitudinal axis of the passageway 632. The O-ring 620 seals off the production tubing passageways 632 and 634; and forms a seal between the production tubing passageways 632 and the 634 and the transport tube passageways 625 and 630.

The box coupler 600 also includes O-rings 616 and 619 to form seals between the transport tube passageways 625 and 630 and the outside of the box coupler 600. The O-rings 616 and 619 reside in respective annular grooves that are formed in the exterior surface of a generally cylindrical seal sleeve 618; and these grooves (and O-rings 616 and 619) generally circumscribe the longitudinal axis of the sleeve 618. As depicted in FIG. 14, the seal sleeve 618 circumscribes the extension 612; one end of the seal sleeve 618 holds the O-ring 616 and is inserted into the groove 614; and the other end of the seal sleeve 618 holds the O-ring 619. The O-ring 616 forms a seal between the seal sleeve 618 and the box end body 604; and the O-ring 619 forms a seal between the seal sleeve 618 and the pin end body 603.

For purposes of mechanically connecting the box and pin ends of the box coupler 600 together, the pin end body 603 includes an extension 642 that circumscribes the seal sleeve 618, and the box end body 604 includes an extension 640 that also circumscribes the seal sleeve 628. In some embodiments of the invention, the extensions 640 and 642 meet to mechanically connect the pin and box ends of the box coupler 600 together. More specifically, in some embodiments of the invention, the extensions 640 and 642 meet at a junction to form a "snap-fit" connection, as described below, for purposes of attaching the extensions 640 and 642 together.

More specifically, in some embodiments of the invention, this snap-fit connection is formed between female connectors (that are located in the extension 640, for example) that mate with male connectors (that are located in the extension 642, for example). As an example, the male-female connector pairs may be uniformly spaced around the ends of the extensions 640 and 642.

Figure 15:
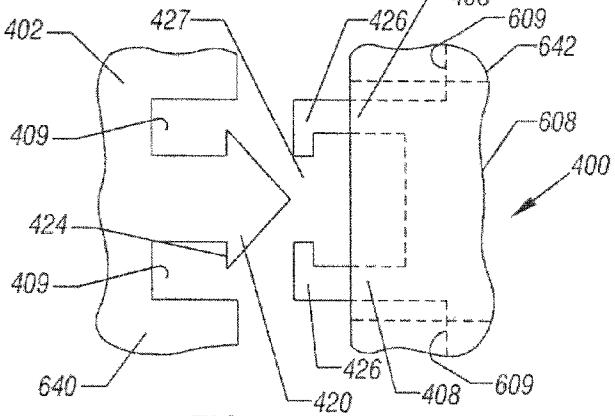
FIG. 15 is a detailed schematic view of a latch connection used by the box coupler of FIG. 14 according to an embodiment of the invention.

An exemplary male-female pair of connectors is depicted in FIG. 15. The female connector includes a pair of fingers 408 that define an opening 427 for receiving an arrowhead-shaped prong 420 of a corresponding male connector. When the prong 420 is inserted into the opening 427, inwardly extending tabs 426 that are located on the ends of the fingers 408 are deflected outwardly to permit the prong 420 to be received into the opening 427. After the prong 420 is received in the opening 427, the tabs 426 return back to their non-deflected positions to engage the rear shoulders 424 of the prong 420 to prevent the prong 420 from being removed from the opening 427. A sleeve 608 that circumscribes the extensions 640 and 642 where the extensions meet may include a slot 609 that receives the fingers 408 and limits the deflection of the fingers 408. Thus, the sleeve 608 may be slid into place after the opening 427 receives the prong 420 for purposes of locking the connector.

In some embodiments of the invention, the box coupler may use other mechanisms to mechanically connect the box and pin ends of the box coupler. For example, referring to FIG. 16, a box coupler 650 may be used to join production tubing and transport tube sections together. The box coupler 650 includes a generally cylindrical body 652 that forms a pin end of the coupler 650. The body 652 includes a passageway 683 to communicate transport tube fluids and a passageway 682 to communicate production fluids. When the box coupler 650 is assembled together, the passageways 683 and 682 align with corresponding transport tube 685 and production tubing 684 passageways, respectively, of a generally cylindrical box end body 653 of the box coupler 650.

Figure 16:
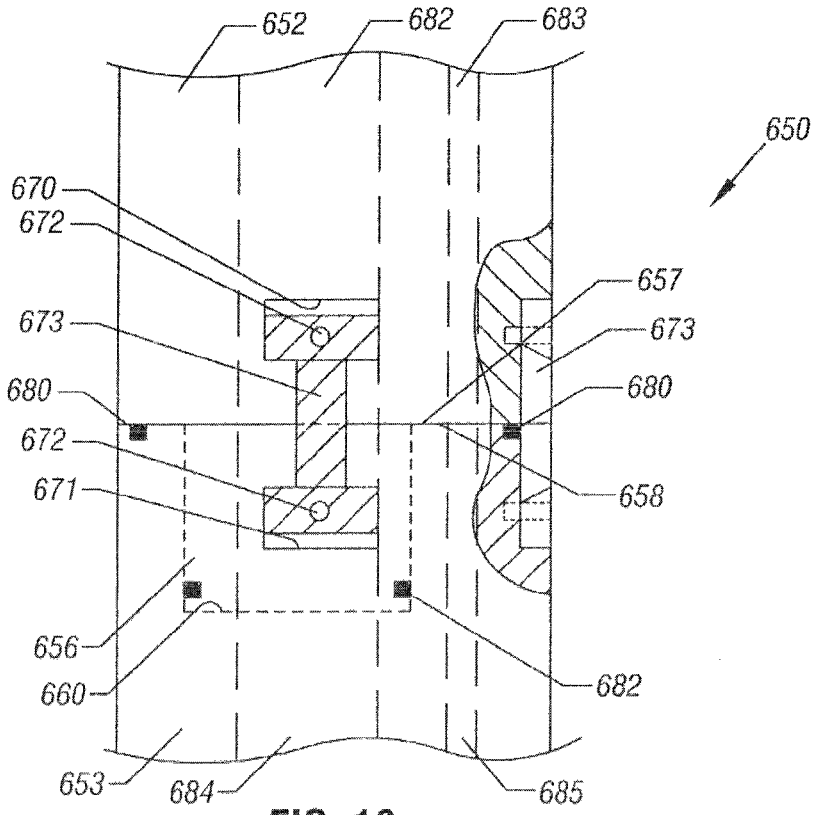
FIG. 16 is a schematic diagram of a box coupler that connects tubular sections using an I-shaped coupling member according to an embodiment of the invention.

The pin end 652 and box end 653 bodies have annular faces 657 and 658 that meet when a extension 656 of the pin end body 652 stabs into a mating opening 660 of the box end body 653. As depicted in FIG. 16, the box coupler 650 may include an O-ring 682 to form a seal between the extension 656 and the opening 660. Furthermore, the box coupler 650 may include an O-ring 680 to form a seal between the adjoining annular faces 657 and 658.

In some embodiments of the invention, a T-shaped recess 670 is formed in the exterior surface of the pin end body 652, and a T-shaped recess 671 is formed in the exterior surface of the box end body 653. The recesses 670 and 671 are oriented 180 degrees with respect to each other so that collectively, the recesses 670 and 671 form an I-shaped recess, or "dog bone" recess, for receiving a corresponding I-shaped coupling member 673.

Thus, when the pin end body 652 is stabbed into the box end body 653, the recesses 670 and 671 align so that the coupling member 673 may be inserted into the I-shaped formed recess to lock the pin end 652 and box end 653 bodies together. Furthermore, screws 672 may be used to secure the coupling member 673 to the pin end 652 and box end 653 bodies. The coupling member 673 sustains tensile and torsions loading on the box coupler 650.

In some embodiments of the invention, the box coupler 650 may include multiple coupling members, such as the two coupling members 673 that are depicted in FIG. 16, that are equally spaced around the longitudinal axis of the box coupler 605 for purposes of absorbing the tensile and torsions forces on the box coupler 650.

Figure 17:
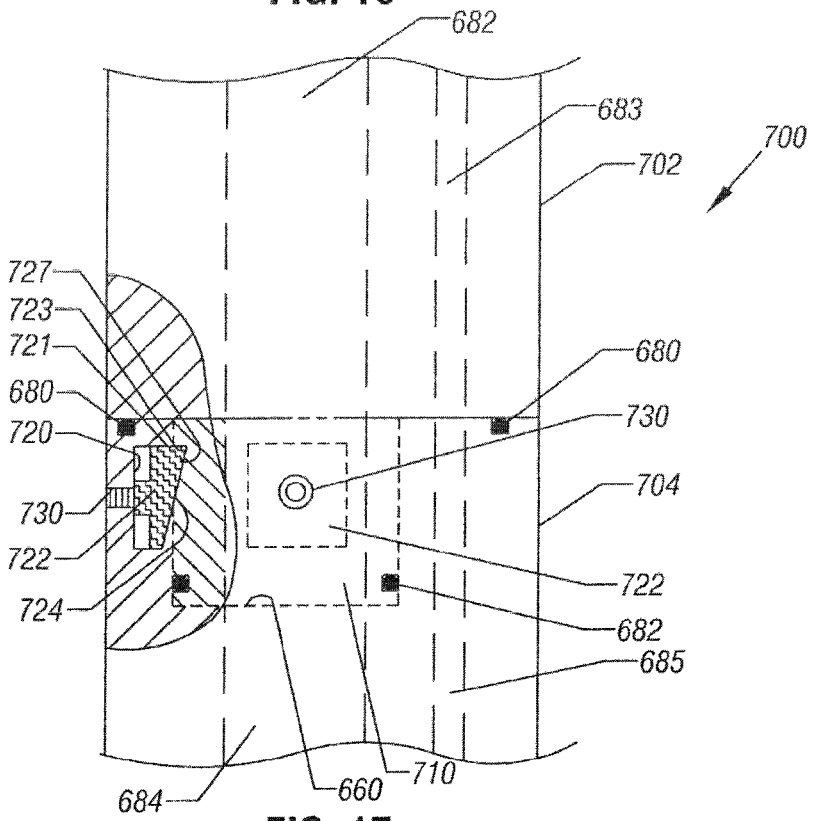
FIG. 17 is a schematic diagram of a box coupler that connects tubular sections using a dog according to an embodiment of the invention.

Referring to FIG. 17, in some embodiments of the invention, a box coupler 700 may be used in place of the box coupler 650. The box coupler 700 has similar features to the box coupler 650, with the following differences. Unlike the box coupler 650, the box coupler 700 does not use I-shaped coupling members to hold its pin and box ends together.

The box coupler 700 includes a pin end body 702 that is similar to the pin end body 652 except that the body 702 does not include the recess 670. Instead, the body 702 includes a stabbing extension 710 (in place of the extension 656) that has an inclined notch, or recess 727, for receiving an inclined face 724 of a dog 722 after the extension 710 has been inserted into the opening 660. The recess 727 aligns with a recess 720 in a box end body 704 of the box coupler 700.

Before the extension 710 is inserted into the opening 660, the dog 722 resides in the recess 720 in the box end body 704. After the extension 710 is inserted into the opening 660, a screw 730, or other mechanism, is used to force the dog 722 in a radial inward direction so that the dog 722 enters the recess 727 and presses against the extension 710. The pin and box ends of the box coupler 700 at this stage cannot be separated because of the force exerted on an upper edge 721 of the dog 722 by the wall of the recess 720. This force is attributable to the angled contact of the dog 722 with the extension 710.

In some embodiments of the invention, the box coupler 700 may include multiple dogs 722 that are equally spaced around the longitudinal axis of the box coupler 700.

Figure 18:
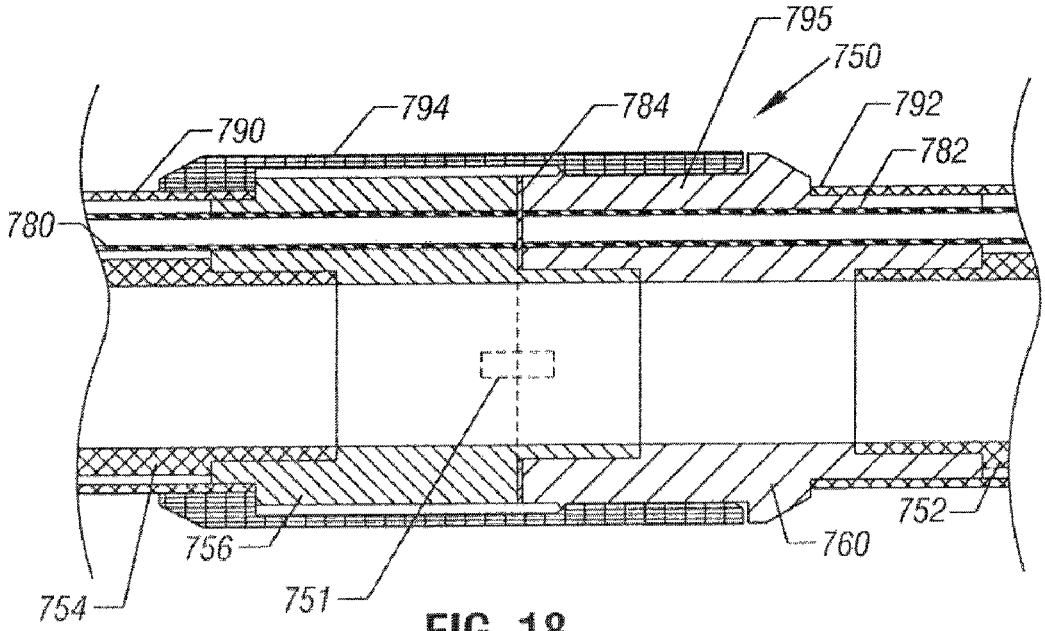
FIG. 18 is a schematic diagram of a box coupler that uses an outer tension sleeve to connect the box and pin ends of the coupler together according to an embodiment of the invention.

Referring to FIG. 18, in another embodiment of the invention, a box coupler 750 includes a pin end body 756 that stabs into a box end body 760 of the coupler 750. The pin end body 756 includes a transport tube section 780 that communicates with a transport tube section 782 of the box end body 760 when the two bodies 756 and 760 mate. Furthermore, the pin end 756 and box end 760 bodies include passageways for establishing communication between production tubing sections 754 and 752 that are connected to the pin end 756 and box end 760 bodies, respectively. The box coupler 750 includes face seals (not shown) between the pin end 756 and box end 760 bodies to seal the transport tube and production tubing passageways.

The pin end 756 and box end 760 bodies are mechanically held together by a tension sleeve 794 that circumscribes the pin end 756 and box end 760 bodies. More specifically, to assemble the box coupler 750, the tension sleeve 794 is slid across the junction between the pin end 756 and box end 760 bodies so that inner threads of the tension sleeve 794 engage outer threads 795 on the box end body 760. The tension sleeve 794 is then rotated to force the pin end 756 and box end 760 bodies together and energize the face seals between them. In some embodiments of the invention, the box coupler 750 includes dowel pins 751 (one dowel pin 751 depicted in FIG. 18), or other such torsion-transmitting devices, that extend between both bodies 756 and 760 to prevent one body 756, 760 from rotating with respect to the other.

Figure 19:
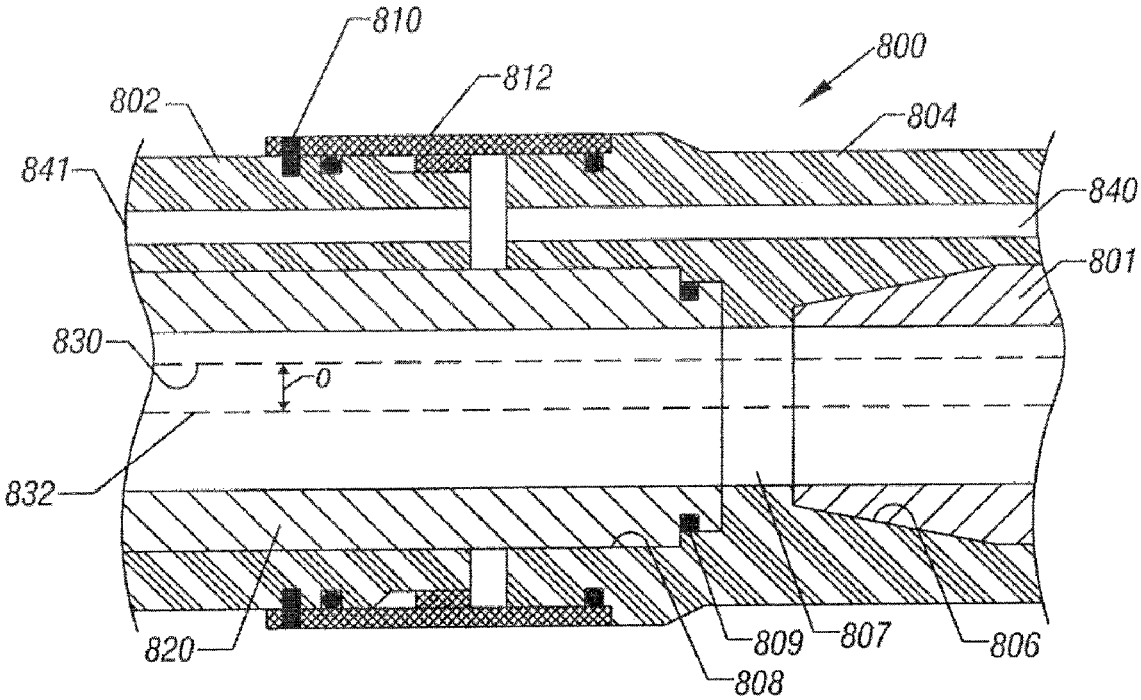
FIG. 19 is a schematic diagram of an eccentric box coupler according to an embodiment of the invention.

Box couplers that are described above may be concentric with respect to the production tubing sections. However, box couplers in accordance with some embodiments of the invention may be eccentric with respect to the production tubing sections. For example, referring to FIG. 19, a box coupler 800 has a box end body 804 that includes a transport tube passageway 840 and a pin end body 802 that includes a transport tube passageway 841. The box end body 804 includes an opening 806 (a tapered opening, for example) to receive an end of a production tubing section 801. The box end body 804 also includes an opening 808 (a non-tapered opening, for example) to receive an end of another production tubing section 820. The openings 806 and 808, as well as a passageway 807 of the body 804 connecting the openings 806 and 808 are concentric with respect to a longitudinal axis 832 of the production tubing sections 801 and 820.

The longitudinal axis 830 of the box coupler 800, however, is eccentric with respect to the production tubing longitudinal axis 832. Thus, an eccentricity offset (labeled "O" in FIG. 19) exists between the axes 830 and 832. This eccentricity offset serves as a locking mechanism for the box coupler 800 to secure the pin and box ends of the coupler 800 together. Similar to box couplers described above, the box coupler 800 includes a sleeve 812 that in its extended position (depicted in FIG. 19) seals the transport tube sections 840 and 841 together. Due to the eccentricity offset, torque on the box coupler 800 is transmitted through the sleeve 812. Disengagement of the sleeve 812 is prevented through one or more retaining devices 810 (screws, for example) that secure the sleeve 812 to the pin end body 802.

Figure 20:
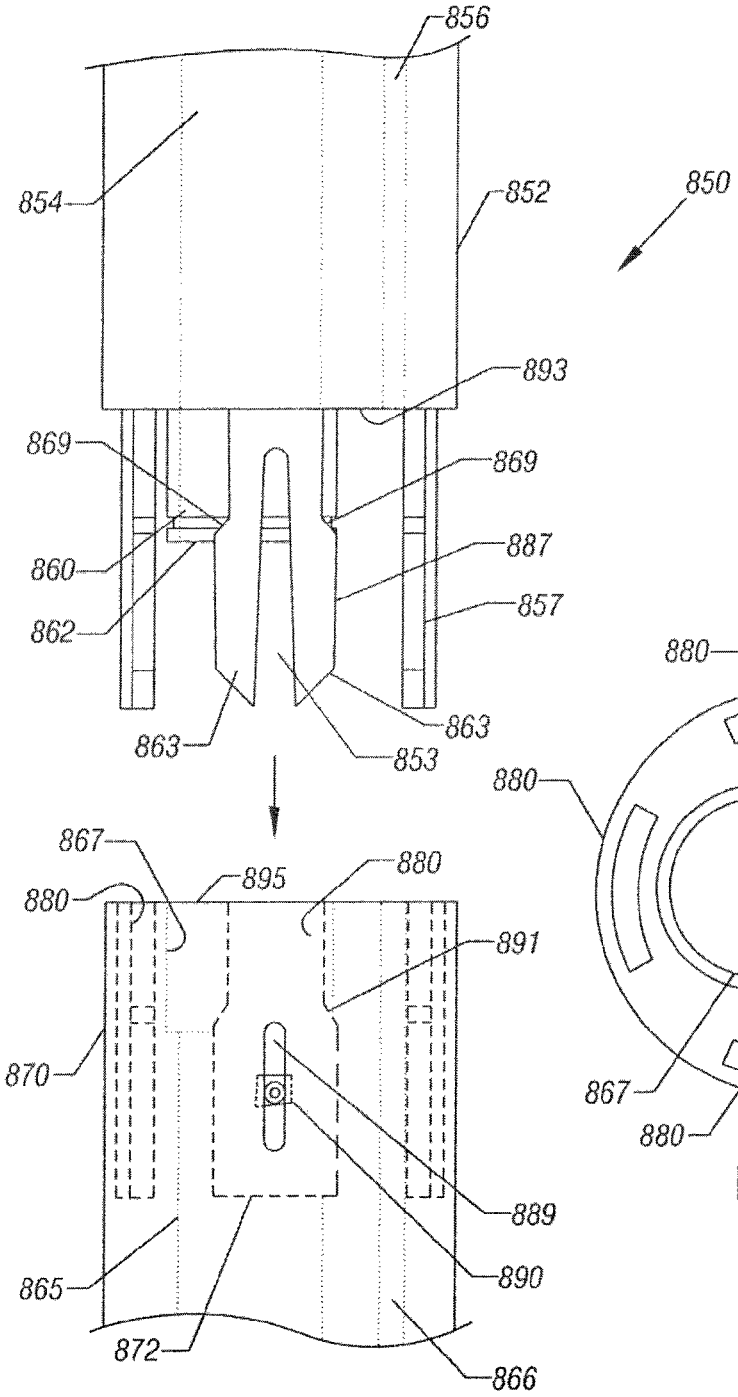
FIG. 20 is a schematic diagram of a stabbing-type box coupler according to an embodiment of the invention.

Referring to FIG. 20, in accordance with another embodiment of the invention, a box coupler 850 includes a pin housing 852 that includes a production fluid passageway 854 and a transport tube passageway 856. A production tubing 860 extends from the pin housing 852 and includes a stabbing profile 862 for insertion into a stabbing receptor 867 of a box housing 870 of the coupler 850. Not shown in FIG. 20 is a stabbing seal that seals the production tubing 860 to the box housing 870. The box housing 870 also includes a passageway 865 to communicate fluid to a production tubing section (not shown) that is connected to the box housing 870. Thus, when the box coupler 850 is assembled together, the production fluid passageways 854 and 865 are sealed together.

The box coupler 850 includes stabbing projections 857 that are radially and uniformly spaced around the box coupler 850. Each projection 857 is constructed to stab into a corresponding recess pocket 880 formed in the box housing 870. The projection 857 includes two fingers 863 that are separated by a space 853. The span of the space 853 increases along a direction from the top to the bottom of the space 853. The space 853 is constructed to receive a translating wedge 890 that is slidably connected to the box housing 870. More specifically, the translating wedge 890 is constructed to slide in a longitudinal direction along a longitudinal slot 889 in the housing 870. When the projection 857 is inserted into the pocket 880, upward movement of the wedge 890 causes the fingers 863 to spread apart.

The spreading of the fingers 863 causes upper inclined shoulders 869 of the fingers 863 to contact corresponding inclined surfaces 891 of the pocket 880. This contact, in turn, draws the stabbing projections 857 into the pockets 880 and thus, joins the pin 852 and box 870 housings together. When joined together, an annular face 893 of the pin housing 852 contacts an annular face 895 of the box housing 870.

Figure 21:
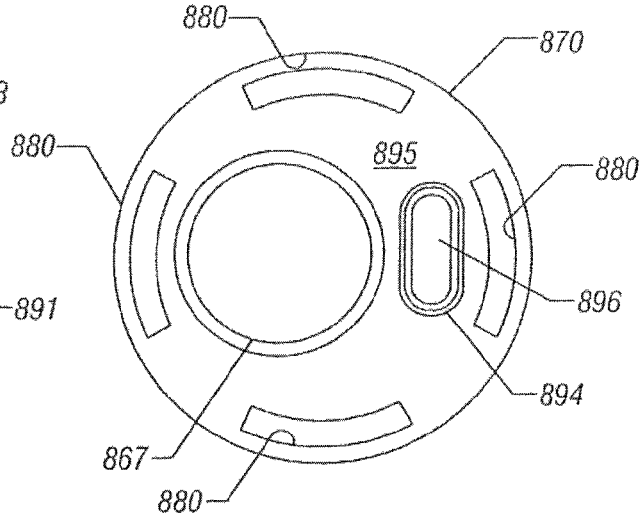
FIG. 21 is a top view of a pin end of the box coupler of FIG. 20 according to an embodiment of the invention.

A top view of the annular face 895 of the box housing 870 is depicted in FIG. 21. As shown, in some embodiments of the invention, the annular face 895 may include openings for several pockets 880 and an opening for the stabbing receptor 867. As depicted in FIG. 21, the annular face 895 also includes an opening 896 for the transport tube passageway 866 of the box housing 870. The annular face 895 also includes a groove that circumscribes the opening 896 and holds a sealing element 894 that forms a seal between the two annular faces 893 and 895 and thus, forms a seal between the transport passageways 856 and 866.

In the embodiments of the box coupler described above, the box coupler connects transport tube and production tubing sections together. However, the invention is not limited to production tubings and transport tubes. Rather, the box couplers that are described herein may be used to connect any base pipe sections (production tubing sections, as a more specific example) and auxiliary tube sections (control line sections or transport tube sections, as more specific examples) together.

Figure 22A:
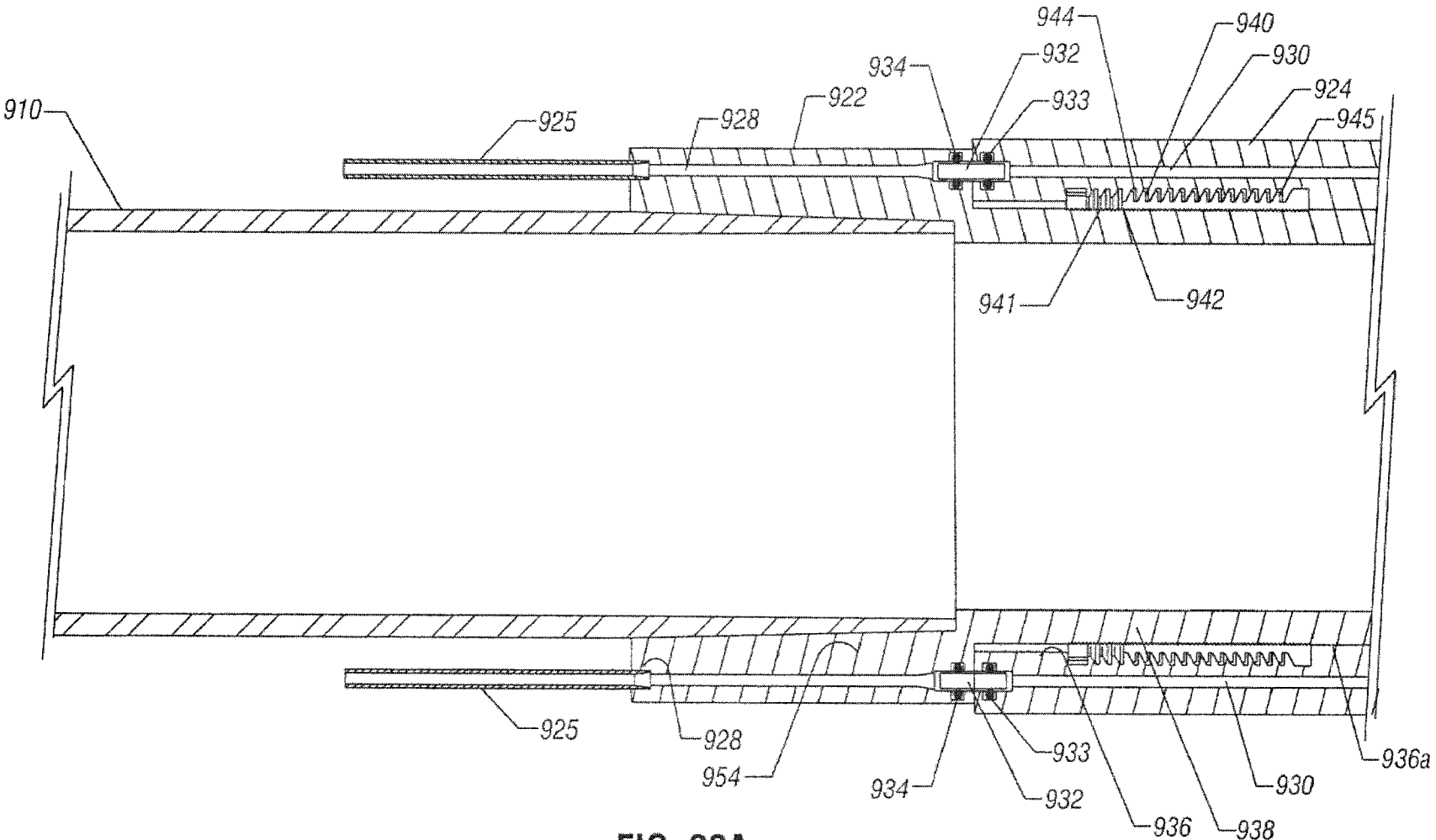
FIGS. 22A and 22B are schematic diagrams of a box coupler that includes a ratchet mechanism to lock pipes together according to an embodiment of the invention.
Figure 22B:
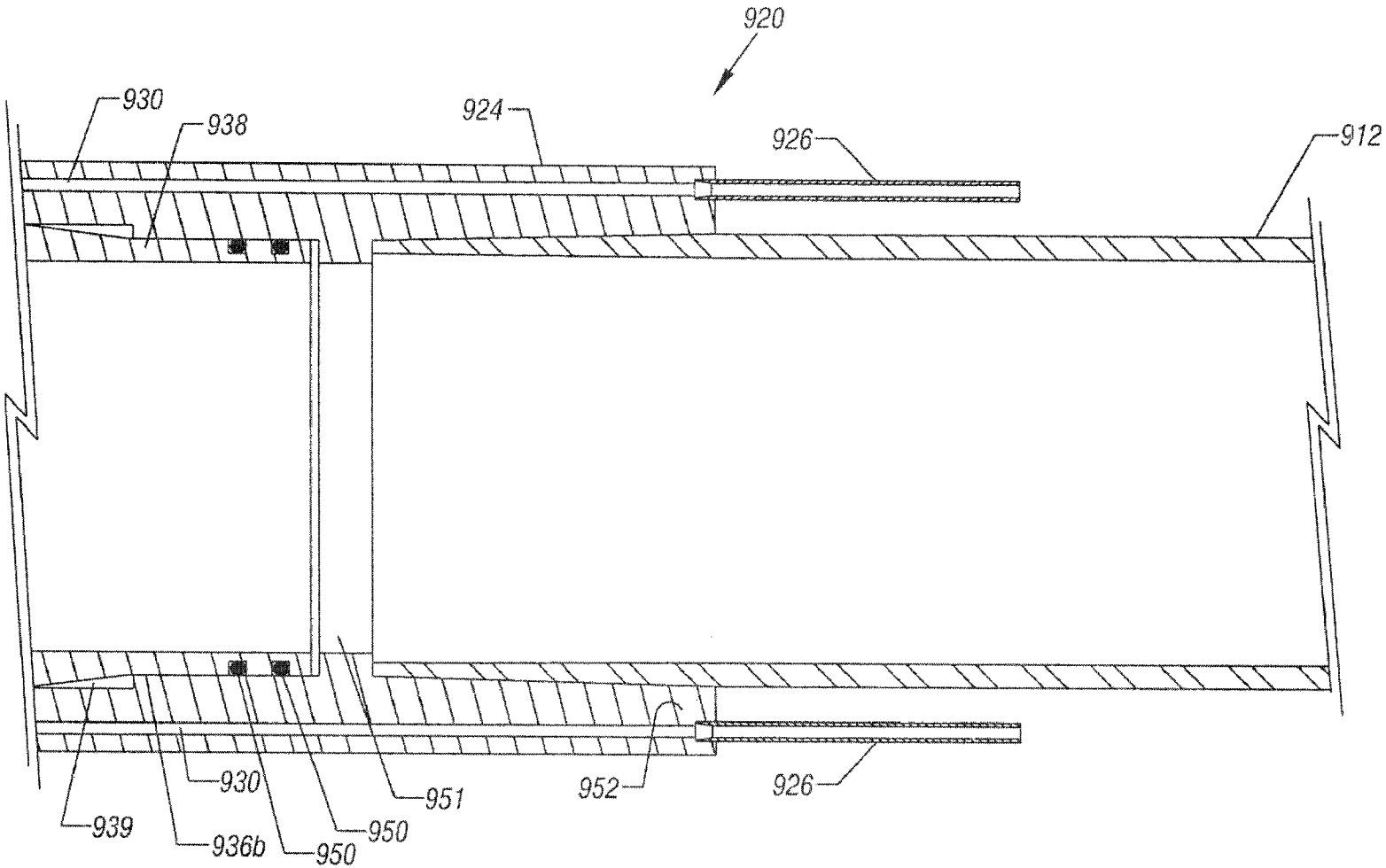

For example, FIGS. 22A and 22B depict a box coupler 920 according to another embodiment of the invention. The box coupler 920 has a pin end that is formed from a pin housing 922 and a box end that is formed from a box housing 924. The box housing 924 includes an opening 952 that receives an end of a base pipe 912. The box housing 924 also includes openings to form connections with control lines 926; and the box housing 924 includes a passageway 930 for each control line 926.

At its other end, the box housing 924 has an opening 936 that is concentric with the base pipe 912 and receives a stabbing extension 938 of the pin housing 922. The extension 938 has a passageway to communicate fluid with a base pipe 910 that is connected to the pin housing 922. The box housing 924 includes a passageway 951 that is concentric to and permits communication between the extension 938 and the base pipe 912.

The opening 936 has a narrower seal region 936*b* located closer to the end of extension 938. The region 936*b* of the opening 936 provides a surface to contact O-rings 950 of the extension 938 for purposes of forming a seal between the extension 938 and the box housing 924 and thus, seal the base pipes 910 and 912 together.

Farther from its end, the opening 936 has a wider region 936*a* to receive the extension 938 and a ratchet sleeve 940 that circumscribes the extension 938 when the extension 938 is inserted into the opening 936, as depicted in FIGS. 22A and 22B. The ratchet sleeve 940 has exterior threads 945 that engage mating threads 940 formed in the interior wall (of the box housing 924) that circumscribes the opening 936*a*. The ratchet sleeve 940 is part of the box end of the box coupler 920. Thus, before the extension 938 is inserted into the opening 936, the ratchet sleeve 940 is threaded into the opening 936.

The ratchet sleeve 940 includes ratchet teeth 941 on the interior surface of the sleeve 940. These ratchet teeth 941 engage ratchet teeth 942 that are formed on the exterior surface of the extension 938 when the extension is inserted into the opening 936. The ratchet teeth 940 and 941 interact to restrict the movement of the extension 938 so that the extension 938 only moves further into the opening 936. Thus, the ratchet teeth 940 and 941 form a locking mechanism to secure the pin housing 922 to the box housing 924.

The pin housing 922 includes a tapered opening 954 that is concentric to the extension 938 and is constructed to receive the tapered end of a base pipe 910. The tapered opening 954 is in communication with the passageway of the extension 938. Therefore, when the box coupler 920 is assembled together, communication is established between the base pipes 910 and 912.

The pin housing 922 also connects to control lines 925, each of which is associated with one of the control lines 926 that are connected to the box housing 924. The pin housing 922 includes a passageway 928 to communicate fluid with each of the control lines 925. Each passageway 928, in turn, is associated with a passageway 930 of the box housing 924.

For purposes of connecting the passageways 928 and 930 together, the box coupler 920 includes the following structure for each connection. This structure includes a tube 932 that has a first end that is inserted into the passageway 928 of the pin housing 922. The other end of the tube 932 protrudes outside of the pin housing 922 so that when the pin housing 922 is inserted into the box housing 924 (as depicted in FIGS. 22A and 22B), this end of the tube 932 enters the passageway 930. The end of the tube 932 inside the passageway 928 is sealed to the pin housing 922 via an O-ring 934 that resides in an annular groove that is formed in a wall of the passageway 928 and circumscribes the tube 932. The end of the tube 932 inside the passageway 930 is sealed to the box housing 924 via an O-ring 933 that resides in an annular groove that is formed in a wall of the passageway 930 and circumscribes the tube 932. The tube 932 extends a sufficient distance into the passageway 930 to provide a tolerance range for connecting the pin and box housings of the box coupler 920 together.

Other embodiments are within the scope of the appended claims. For example, the tubular members that are depicted in the various figures mostly have circular cross-sections. However, in other embodiments of the invention, these tubular members may have non-circular cross-sections. For example, the shunt tubes may have round, oval, kidney-shaped or another geometric cross-section, according to the particular embodiment of the invention.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

connecting a first production tubing section to a second production tubing section;

moving a member from a retracted position to an extended position to form a sealed connection between a first gravel packing transport tube that is connected to the first tubing section and a second gravel packing transport tube that is connected the second tubing section; wherein the moving comprises moving a sleeve between the retracted position and the extended position;

attaching a first body to the first production tubing section;

mounting the sleeve to the first body;

attaching a second body separate from the first body to the second production tubing section;

receiving an end of the first production tubing section in the first body; and receiving an end of the second production tubing section in the first body.

2. The method of claim 1, wherein the moving comprises: sliding the sleeve between the retracted position and the extended position.

3. The method of claim 1, further comprising:

providing a first passageway in the first body; and providing a second passageway in the second body, wherein the first gravel packing transport tube and the second gravel packing transport tube communicate through the first and second passageways.

4. The method of claim 3, further comprising:

using the sleeve to bridge a gap between the first body and the second body to seal the first and second passageways.

5. The method of claim 4, further comprising:

using an opening in the sleeve to permit communication between the first and second passageways.

6. The method of claim 1, further comprising: providing a tapered opening in the second body to receive the first production tubing section.

7. The method of claim 1, further comprising:

using the sleeve to bridge a gap between the first body and the second body; and providing a sealing element between the sleeve and the second body.

8. The method of claim 7, wherein the sealing element is located on an exterior surface of the second body and circumscribes a longitudinal axis of the second body.

9. The method of claim 7, wherein the sealing element is located on an exterior surface of an annular face of the second body.

10. The method of claim 1, further comprising:

providing a passageway in the first body to establish communication through the first body between the first gravel packing transport tube and the second gravel packing transport tube; and forming a seal between a wall of the passageway and the sleeve.

11. The method of claim 1, wherein the sleeve closely circumscribes the first body.

12. The method of claim 1, wherein the member is eccentric with respect to the first production tubing section.

* * * * *